US011002026B1

(12) United States Patent
Apostolopoulos et al.

(10) Patent No.: US 11,002,026 B1
(45) Date of Patent: May 11, 2021

(54) ADJUSTABLE SUSPENSION ASSEMBLY

(71) Applicant: Paul Kristen, Inc., Tonawanda, NY (US)

(72) Inventors: Paul Apostolopoulos, Clarence, NY (US); Davy E. Passucci, Clarence Center, NY (US)

(73) Assignee: Paul Kristen, Inc., Tonawanda, NY (US)

( * ) Notice: Subject to any disclaimer, the term of this patent is extended or adjusted under 35 U.S.C. 154(b) by 0 days.

(21) Appl. No.: 16/812,129

(22) Filed: Mar. 6, 2020

(51) Int. Cl.

| | |
|---|---|
| ***E04G 3/30*** | (2006.01) |
| ***E04G 5/06*** | (2006.01) |
| ***E04G 7/22*** | (2006.01) |
| ***E04G 7/04*** | (2006.01) |

(52) U.S. Cl.
CPC ..... *E04G 3/30* (2013.01); *E04G 5/061* (2013.01); *E04G 7/04* (2013.01); *E04G 7/22* (2013.01)

(58) Field of Classification Search
CPC ... F16G 11/00; E04G 7/04; E04G 3/30; E04G 5/061
See application file for complete search history.

(56) References Cited

U.S. PATENT DOCUMENTS 1,395,308 A * 11/1921 Sykes ..... E04G 7/04 248/235
1,502,031 A * 7/1924 Gray ..... E04G 7/04 24/481
2,025,377 A 12/1935 Crannell
2,057,092 A 10/1936 Geib
2,524,302 A * 10/1950 Benson ..... E04G 3/30 182/150
2,556,105 A * 6/1951 Rhett ..... A47B 43/006 108/106
3,724,151 A * 4/1973 Kaywood ..... B60P 3/073 52/295
4,103,871 A 8/1978 Patterson, III et al.
4,253,549 A 3/1981 Petren
4,348,000 A * 9/1982 Hanner ..... G01B 5/0002 248/230.9
4,388,982 A * 6/1983 Yonahara ..... E04G 3/20 182/115

(Continued)

FOREIGN PATENT DOCUMENTS

DE 1187001 B * 2/1965 ..... E04G 7/04
GB 2092257 A 8/1982

*Primary Examiner* — Colleen M Chavchavadze
(74) *Attorney, Agent, or Firm* — James C. Simmons

(57) ABSTRACT

An adjustable suspension assembly for suspending a lower structure such as a platform from an upper structure such as a portion of a bridge. A sling, which is attachable at one end to the upper structure, is attached at its other end to one end of a chain. A device, which is attachable to the lower structure, has a pair of aligned apertures in its side walls for receiving pins. The pins are spaced to receive a thickness of a chain link but not to receive a width of the link, whereby a selected link to achieve a desired lower structure height may be cinched between the pins. The other end of the sling, which comprises a cable, has an eyelet formed by folding an end portion of the cable back over the cable and swaging the cable end portion to the cable. The chain is attached to said eyelet by receiving the end portion of the cable in one of the chain links before the cable end portion is swaged to the cable.

11 Claims, 4 Drawing Sheets

(56) References Cited

U.S. PATENT DOCUMENTS 4,413,707 A 11/1983 Lienhard, Sr.
4,441,583 A * 4/1984 Vaught ..... E04G 3/22 182/150
4,516,661 A * 5/1985 Stafford ..... E04G 3/30 182/229
4,556,126 A 12/1985 Wait
4,815,563 A * 3/1989 Puccinelli ..... E04G 3/30 182/113
4,854,419 A 8/1989 Lyras et al.
4,934,675 A * 6/1990 Klocke ..... B25B 1/205 269/111
4,997,062 A * 3/1991 Pizzo ..... E04G 3/30 182/132
5,007,501 A * 4/1991 Baston ..... E04G 1/152 182/128
5,107,959 A * 4/1992 Lubinski ..... E04G 3/30 182/113
5,351,926 A * 10/1994 Moses ..... A61B 6/4464 248/343
5,397,090 A 3/1995 Carson et al.
5,730,248 A 3/1998 Apostolopoulos
5,921,346 A 7/1999 Apostolopoulos
6,003,634 A 12/1999 Apostolopoulos
6,138,793 A 10/2000 Apostolopoulos
6,135,240 A 11/2000 Apostolopoulos
6,227,331 B1 5/2001 Apostolopoulos
6,264,002 B1 7/2001 Apostolopoulos
6,299,118 B1 10/2001 Farrell
6,302,237 B1 10/2001 Apostolopoulos
6,386,319 B2 5/2002 Apostolopoulos
6,523,644 B2 2/2003 Apostolopoulos
6,595,145 B1 * 7/2003 Lietz ..... A47B 43/006 108/106
6,851,895 B2 * 2/2005 Jarry ..... B63B 21/22 405/224
7,325,778 B2 2/2008 Kuhn
7,367,538 B2 5/2008 Berlyn
7,941,986 B2 5/2011 Jolicoeur et al.
8,123,001 B1 2/2012 Apostolopoulos et al.
8,438,827 B2 5/2013 Mulle
8,465,063 B1 * 6/2013 Jones ..... E05B 65/0007 292/264
8,516,784 B2 8/2013 Lozano
8,789,248 B2 7/2014 McKay
9,038,353 B2 * 5/2015 Huncovsky ..... E04H 12/2292 52/835
9,217,451 B2 12/2015 Apostolopoulos et al.
9,309,633 B2 4/2016 Apostolopoulos et al.
9,598,832 B2 * 3/2017 Abrisketa Lozano .. E02D 5/223
9,784,001 B1 10/2017 Apostolopoulos
9,896,852 B2 2/2018 Apostolopoulos et al.
10,266,998 B2 4/2019 Apostolopoulos et al.
10,267,349 B2 4/2019 Apostolopoulos et al.
10,280,635 B1 5/2019 Apostolopoulos et al.
10,738,423 B1 6/2020 Apostolopoulos et al.
2004/0020138 A1 * 2/2004 Grearson ..... E01D 19/106 52/64
2009/0159773 A1 6/2009 Nordbrock
2013/0019582 A1 * 1/2013 Abrisketa Lozano .. F16G 15/06 59/86
2018/0135316 A1 5/2018 Apostolopoulos et al.
2020/0031635 A1 * 1/2020 Hernandez Ortiz .... B66C 15/00

* cited by examiner

ADJUSTABLE SUSPENSION ASSEMBLY

The present invention relates generally to scaffolding, for example, the temporary erection of platforms below a bridge deck so that cleaning, painting, or other maintenance work may be performed thereon. More particularly, the present invention relates to suspension devices such as slings used, for example, for attaching such platforms or other scaffolding members to overhead structures such as bridge decks so that they are suspended at a desired height therefrom. The present invention is also applicable for the suspension of other things.

Applicant's company, Safespan Platform Systems, Inc., has for many years provided and erected temporary platforms or scaffolding below bridge decks, as exemplified in U.S. Pat. Nos. 5,730,248; 5,921,346; 6,003,634; 6,135,240; 6,138,793; 6,227,331; 6,264,002; 6,302,237; 6,386,319; 6,523,644; 8,123,001; 9,217,451; 9,309,633; and 9,784,001; 9,896,852; 10,266,998; 10,267,349; and 10,280,635, and U.S. published application 2018/0135316, all of which patents and published application are incorporated herein by reference.

Such a sling is illustrated at 32 in FIGS. 1, 2, and 30 of the aforesaid U.S. Pat. No. 6,523,644 (wherein it is called an auxiliary support cable), wherein the lower ends of slings are attached to a platform (which is also supported by underlying cables) and their upper ends are attached to bridge structure.

Such a sling is also illustrated at 12 in FIG. 1 of the drawings for the present application. This sling 12 is of a type which is non-adjustable and has been used for many years in scaffolding with great effectiveness when the platform height or other height is fixed and requires no adjustability. This sling 12 will be discussed hereafter in the Detailed Description of the Preferred Embodiment(s).

There are often instances requiring the adjustment of the lengths of the slings in-situ or in the field during the erection process, and length adjustable slings, wherein the eyelet at one end is formed in the field during the erection process, have been provided for this purpose. A length-adjustable sling is illustrated generally in FIG. 3 of the aforesaid U.S. Pat. No. 9,784,001, and includes a permanent swaged connection at one end. The other end of the cable is looped around to also form an eyelet. Instead of a swage, cable portions are held together to form this eyelet by a plurality of suitable clamps which can be loosened to adjust the sling length then tightened at that desired adjusted sling length. The clamps are typically applied in the field during the erection process, then the cable end pulled through until the desired height or sling length is obtained, then the clamps tightened. While such adjustable slings are effective for their purpose, it undesirably takes a long time to put on the clamps and conduct the adjustment. Moreover, the tightening of the clamps undesirably puts kinks in the cables with the result that it is considered unsatisfactory to re-use the slings. Thus, there has been a long-existing need in the scaffolding industry for suspension assemblies which include slings wherein such a suspension assembly can be more easily length-adjusted and which are satisfactory for re-use.

Chains have been provided with hooks at their ends, and the length has been adjusted (to achieve the desired adjusted height of a suspended structure) by looping (or choking) an end portion of a chain around and attaching it back to itself with a grab hook, such as illustrated in FIG. 6 of U.S. Pat. No. 4,854,419, which is incorporated herein by reference. The chains are undesirably too heavy in longer lengths.

Devices have also been provided which comprise a cable and a chain the ends of which are attached together with a shackle or other piece of hardware. Such shackles (or other hardware) as well as hooks used on the other ends of the chain are undesirably expensive.

Applicant's aforesaid U.S. Pat. No. 9,784,001 discloses a sling attached to an adjustment device for suspending one structure such as a platform at a desired distance below another structure such as a bridge structure. The adjustment device comprises a pair of elongate spaced apart plates which are attached to each other and to a hook at one end, the hook attachable to the one structure. The plates have a plurality of longitudinally spaced aligned holes respectively for receiving a pin for connecting one end of the sling to the adjustment device at a selected incremental one of the pairs of aligned holes. The other end of the sling is connected to the another structure to thereby adjust the distance over which the one structure is suspended below the another structure. While such as assembly is a very effective enhancement, the hook is nevertheless expensive.

It is accordingly an object of the present invention to provide an alternative suspension assembly wherein the length or height over which it is used can be easily adjusted and without the use of expensive hooks or other hardware.

In order to provide such an alternative suspension assembly without the use of expensive hooks, in accordance with the present invention, an adjustment assembly is provided wherein a chain is attached to a sling, and adjustment is provided by cinching a chain link in a less expensive none-hook device which is easily and inexpensively attachable to a platform or other structure to be suspended.

In order to eliminate an expensive shackle or other hardware for attaching ends of the sling and chain, in accordance with the present invention, the sling is a cable an end portion of which is received in a chain link and looped around and swaged to itself, to thereby provide an inexpensive connection of the chain to the sling.

The above and other objects, features, and advantages of the present invention will be apparent in the following detailed description of the preferred embodiment(s) thereof when read in conjunction with the accompanying drawings wherein the same reference numerals denote the same or similar parts.

DETAILED DESCRIPTION OF THE PREFERRED EMBODIMENT(S)

Figure 1:
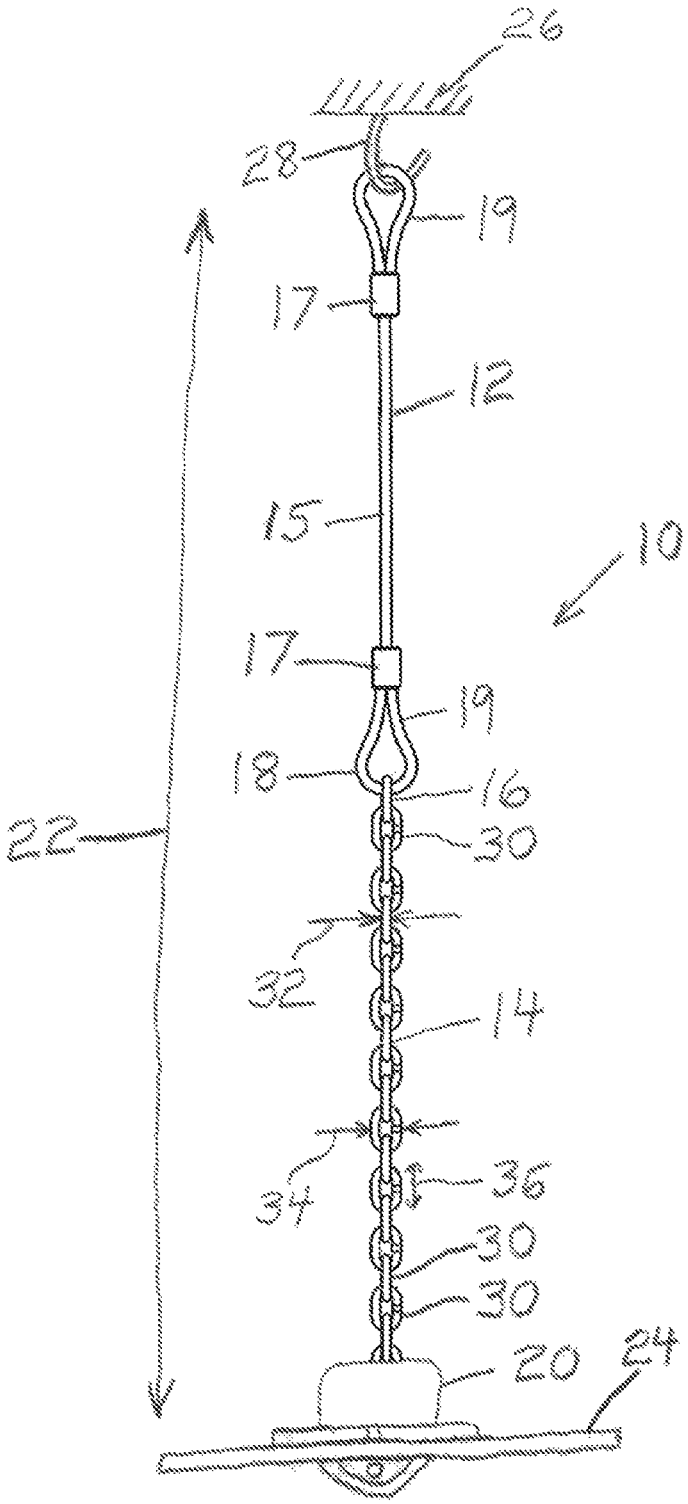
FIG. 1 is a side view, partly schematic, of an adjustable suspension assembly in accordance with the present invention, illustrated suspending a platform from a bridge structure.

Referring to the drawings, there is shown generally at 10 a suspension assembly, which comprises a combination of a conventional sling 12, a chain 14 one end 16 of which is attached to an end 18 of the sling 12 and an other end of which is attached to an adjustment device, illustrated generally at 20, in a manner as described hereinafter for providing adjustability to the overall length or height, illustrated at 22, of the suspension assembly 10 for thereby providing a desired height to a platform 24 to which the adjustment device 20 is attached. Each of the parts thereof, unless otherwise specified or apparent, is composed of steel or other suitable metal or other suitable material.

The sling 12 is a length of cable 15 (or wire rope or other suitable flexible strand) having attachment means in the form of a loop or eye or eyelet 19 at each end wherein the cable 15 is folded back over and attached to itself to form an eyelet or loop, and a protective thimble (not shown) suitably received within the eyelet 19. The sling 12 shown in FIG. 1 is of a type which is non-adjustable, wherein, for each eyelet 19, the respective end portion of the cable 15 is looped back and attached to itself permanently by a swaged connection utilizing a swage sleeve 17 (which may come in various sizes such as, for example, a diameter of ½ inch) which is caused to encircle and firmly grip the respective portions of the cable 15 thereby providing a strong connection of the cable to itself thereby forming the eyelet 19. Such a swaging process for forming an eyelet of a sling is well known in the art to which the present invention pertains. The upper eyelet 19 (the eyelet opposite end 18) is connected to a bridge or other suitable structure, illustrated at 26, by a suitable attachment means such as a clip or hook, illustrated at 28, for use of the suspension assembly 10 for supporting, for example, the platform 24 from the bridge structure 26.

The chain 14 is formed of a plurality of, for example, 21 to 25 interconnected identical links 30 (as needed to provide the desired range of height adjustment), the upper end portion or link 16 (preferably the end link) of which is received on the lower end or eyelet 18 prior to the above described swaging process thereby desirably permanently and inexpensively connecting the upper end 16 of the chain to the lower end 18 of the sling 12.

Unless otherwise stated, illustrative dimensions provided herein are for exemplary purposes only and not for purposes of limitation. Each link 30 for an exemplary chain has, for example, a thickness, a width, and a height, illustrated at 32, 34, and 36 respectively, which, for a suitable chain 14, may, for example, be ⅜ inch, 1¼ inch, and 2 inches respectively, the width 34 being substantially greater than the thickness 32. The chain 14 is of a type wherein, as viewed from a particular direction such as in FIG. 1, alternately the thicknesses 32 and the widths 34 face in that particular direction and have very small or limited rotation ability therefrom. Thus, as viewed in FIG. 1 of the drawings, alternately the thicknesses 32 and the widths 34 face the viewer.

Figure 2:
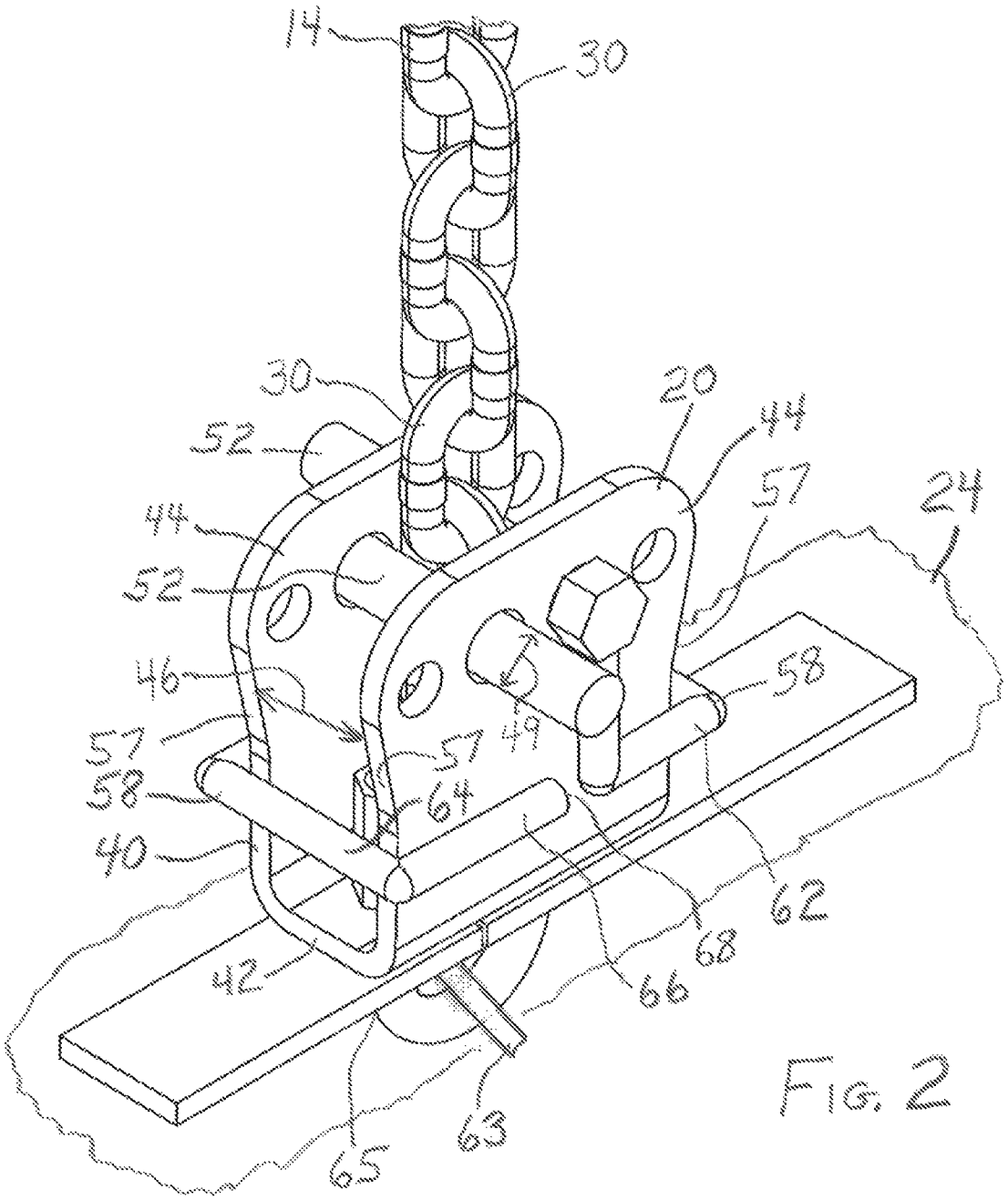
FIGS. 2 and 3 are enlarged perspective view of a portion of the assembly.
Figure 3:
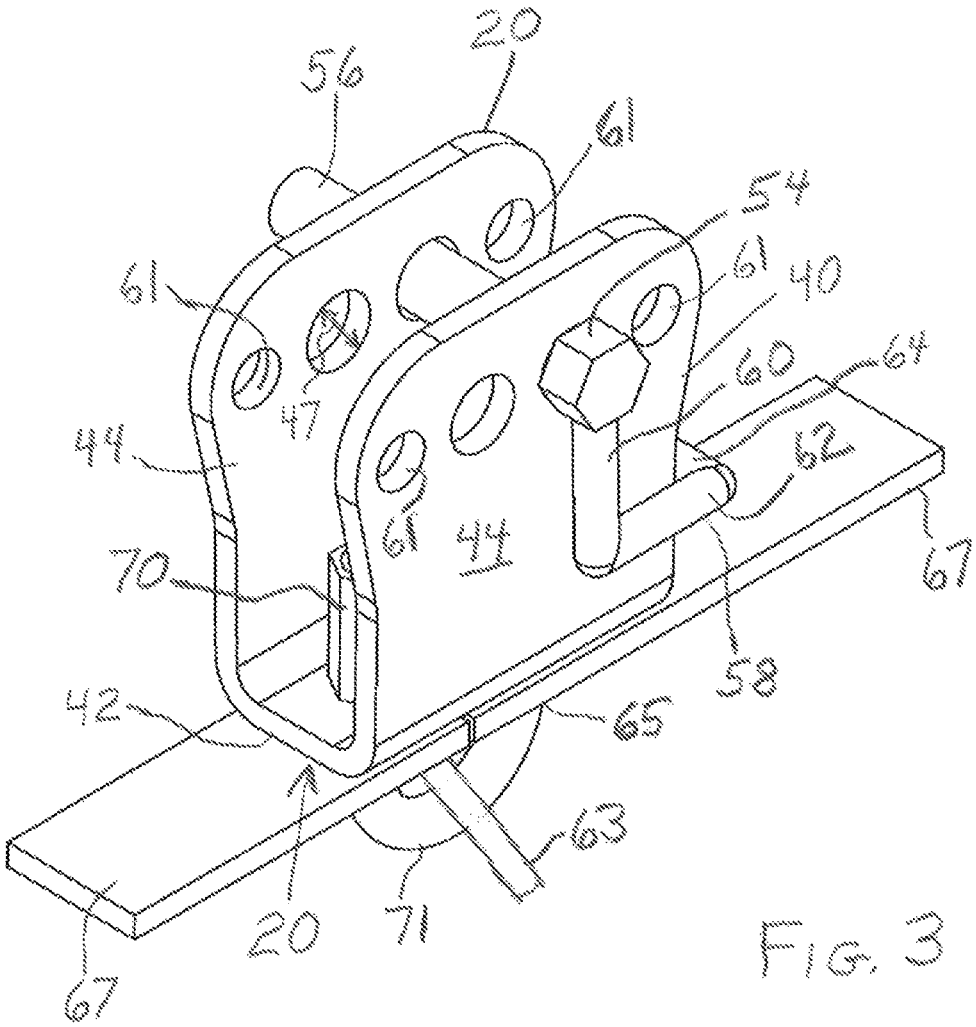
Figure 4:
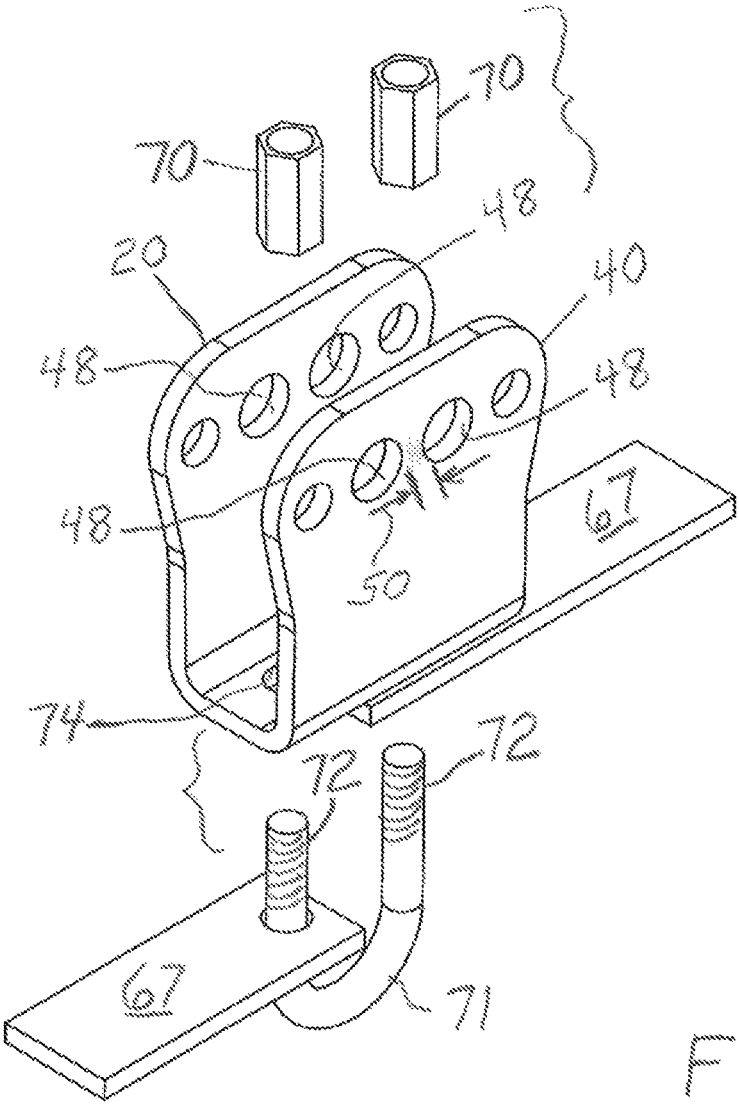
FIG. 4 is a blown up view of a portion of the assembly.

Referring to FIGS. 2 to 4, the device 20 comprises a plate 40 bent or otherwise suitably formed (for example, three flat plates may be welded together to form the plate 40) to define a bottom wall 42 and two side walls 44 which extend upwardly from edges of the bottom wall 42. The spacing, illustrated at 46, between the side walls 44 is greater than the width 34 of a link to allow passage easily of the width 34 of a link there between, as illustrated in FIG. 2. This spacing 46 may, for example, be about 1½ inch.

Each of the side walls 44 has in its upper portion a pair of spaced apertures, illustrated at 48, wherein the apertures 48 in one of the side walls 44 are aligned with the apertures 48 respectively in the other of the side walls 44. A pin 52 is insertable in each aperture 48 in one side wall 44 and the corresponding aligned aperture 48 in the other side wall 44. The pins 52, which have heads 54, are desirably inserted from opposite side walls 44 respectively, as illustrated in FIG. 2. The apertures 48 in each side wall 48 are spaced a distance, illustrated at 50, so that when the pins 52 are inserted in respectively aligned apertures 48, the distance between the pins 52 will be equal substantially or a little more than the thickness 32 of a link and will be substantially less than the width 34 of a link. This distance 50 may, for example, be about 5/16 inch. While this exemplary distance 50 is less than the exemplary link thickness of ⅜ inch, this will nevertheless work because the pin diameters, illustrated at 49, are substantially less than the diameters, illustrated at 47, of apertures 48 thereby to provide plenty of play and wiggle room for receiving a link thickness between the pins and allows the distance between the pins 52 to spread to a distance, for example, ½ inch, which is greater than the distance 50 between the apertures and greater than the exemplary ⅜ inch link thickness for easily accommodating a link thickness.

In order to retain the pins 52 in the respective aligned apertures 48 without the necessity of applying nuts, the pins 52 are preferably scaffold pins, which may also be referred to as adjustment retainers and which are disclosed in the aforesaid U.S. Pat. No. 9,784,001. The scaffold pin includes, in addition to the shank 56 and head 54, a locking part 58 which utilizes gravity for retaining the shank 56 in the respective aligned apertures 48 as follows. The locking part 58 includes a first portion 60 which extends from the head 54 downwardly, a second portion 62 which extends from an end of the first portion 60 along side a lower portion of the respective side wall 44 to just beyond the nearest edge of the respective side wall 44, a third portion 64 which extends from the end of the second portion 62 across both side walls 44, and a fourth portion 66 which extends from the end of the third portion 54 along the respective side wall 44 to a point 68 of termination. It can be seen in FIG. 2 that the fourth portions 66 restrain the pins 52 from being removed from their apertures 48 (due to impingement of the fourth portions 66 against the side walls 44 respectively). It can also be seen that, by movement of the locking parts 58 upwardly, the fourth portions 66 can be made to clear the side walls 44 respectively so that the pins 52 can then be removed from the apertures 48 respectively. The side edges of the side walls 44 are slightly curved inwardly, as seen at 57 in FIG. 2, to allow ease of movement of the locking parts 58 between the lower and upper positions. The force of gravity keeps the locking parts 58 in their downward positions as seen in FIG. 2. When force is applied to the suspension assembly 10 such as by attachment of the platform 24, the pins 52 are pinched in the respective apertures 48 thus further insuring that the pins 52 will not come out of their apertures 48 respectively.

Additional apertures 61 (or at least one additional aperture 61) are provided to the sides of apertures 48 respectively to allow attachment of a lifting device for temporary lifting of the platform 24 so that the cable 14 may be attached to or detached from the device 20 or for any other suitable purpose.

The platform 24 is supported by cables 63 such as shown in, for example, the aforesaid U.S. Pat. No. 5,730,248. The decking 24 is attached to the cables 63 at multiple locations by clips 65 comprising a pair of plates 67 which abut (end edge to end edge) to cover openings (not shown) in the decking 24 and a U-bolt 71 which receives a cable 63, and nuts 70 applied to its two threaded end portions 72 thereby securing the cable 63 to the decking 24 at that point. Similar clips are also shown in the aforesaid U.S. Pat. No. 5,730,248 and in others of the aforesaid patents. For example, a clip may have a J-bolt with one end connected to a plate and the other end receiving a nut. The use of underlying cables to support decking for platforms and the attachment thereof to the decking by clips of various types is well known in the art.

In accordance with the present invention, the end portions 72 of the U-bolt are also received in apertures, illustrated at 74 (one shown), in the bottom wall 42 of the device 20 before the nuts 70 are applied, thereby attaching the device 20 to the platform 24, without the need for expensive hooks or the like. If a different type of clip is used, it may suitably attach the platform 24 to the device 20 using principles commonly known to those of ordinary skill in the art to which the present invention pertains.

In order to suspend the platform 24 at the desired height, the sling eyelet 19 (the one unattached to the chain 14) is suitably attached to an overhanging bridge portion 26 such as by receiving the eyelet on the hook 28. The device 20 as well as an underlying cable 63 are attached to the platform with the U-bolt 71 or as is otherwise suitable. Using a temporary suspension device such as another sling attached at one of the apertures 61 to maintain the platform 24 temporarily lifted, the correct chain link 30 for the desired platform height is selected and its thickness 32 inserted in position between the side walls 44 and the pins 52 inserted into the respective aligned apertures 48 (while suitably holding the locking parts 58 above the side walls 44, then allowing the locking parts to fall by gravity and urging as necessary into locking position after the pins 52 are inserted), thereby cinching the selected link 30 for the desired platform height into position. As seen in FIG. 2, the adjacent links 30 cannot pass width-wise through the spacing 50 between the pins 52 thereby trapping or locking the selected link 30 at the desired height 22 and thereby providing an adjusted height to the suspension assembly 10. To remove the suspension assembly 10, the temporary suspension device is again applied at one of the apertures 61 to relieve force, the locking parts 59 are moved so that the fourth portions 66 are above the side walls 44, and the pins 52 are removed from the apertures 48 respectively and the chain 14 removed from the device 20.

It should be understood that the clip 65 as well as underlying cables 63 are not essential to the present invention and that the suspension assembly 10 may be used to suspend things other than platforms by suitable attachment of the device 20 thereto.

It should be understood that, while the present invention has been described in detail herein, the invention can be embodied otherwise without departing from the principles thereof, and that such other embodiments are meant to come within the scope of the present invention as defined by the appended claims.

What is claimed is:

1. An adjustable suspension assembly comprising:

a sling including a cable one end of which is attachable to a first structure;

a chain having a plurality of links and having an end portion attached to an other end of said cable; and a device attachable to a second structure to be suspended from the first structure, said device including a first plate portion attachable to the second structure, a pair of generally parallel second plate portions, and means for cinching a selected one of said links between said second plate portions to adjust a suspended height of the second structure, said means for cinching including first and second pins, a first pair of aligned apertures in said second plate portions respectively for receiving said first pin, and a second pair of aligned apertures in said second plate portions respectively for receiving said second pin, wherein said first and second pins, when received in said first and second pairs respectively of aligned apertures, are spaced apart a distance which allows passage of a thickness of each of said links and which restrains passage of a width of each of said links, whereby, when the selected one of said links is received between said pins while said pins are received in said first and second pairs respectively of aligned apertures, ones of said links which are adjacent said selected one of said links are restrained from passage between said pins.

2. An assembly according to claim 1 wherein at least one of said second plate portions has at least one additional aperture for attachment of a lifting device to provide temporary lifting of the second structure while the selected link is being cinched.

3. An assembly according to claim 1 wherein said pins are scaffold pins.

4. An assembly according to claim 1 wherein said pins have locking parts which partially surround said device and are held down by the force of gravity to prevent removal of the pins respectively, wherein said locking parts must be lifted against the force of gravity to enable removal of the pins respectively.

5. An assembly according to claim 1 further comprising a clip including a curved shank for attaching underlying cables to a platform, at least one aperture in said first plate portion for receiving at least one threaded portion of said shank, and at least one nut for applying to said at least one threaded portion for attaching said device to said clip.

6. An assembly according to claim 1 wherein said other end of said cable has an eyelet formed by folding an end portion of said cable back over said cable and swaging said end portion of said cable to said cable, and wherein said end portion of said chain is attached to said eyelet by receiving said end portion of said cable in one of said links in said end portion of said chain before said end portion of said cable is swaged to said cable.

7. An adjustable suspension assembly comprising:

a chain having a plurality of links and having an end portion attachable to a first structure; and a device attachable to a second structure to be suspended from the first structure, said device including a first plate portion attachable to the second structure, a pair of generally parallel second plate portions, and means for cinching a selected one of said links between said second plate portions to adjust a suspended height of the second structure, said means for cinching including first and second pins, a first pair of aligned apertures in said second plate portions respectively for receiving said first pin, and a second pair of aligned apertures in said second plate portions respectively for receiving said second pin, wherein said first and second pins, when received in said first and second pairs respectively of aligned apertures, are spaced apart a distance which allows passage of a thickness of each of said links and which restrains passage of a width of each of said links, whereby, when the selected one of said links is received between said pins while said pins are received in said first and second pairs respectively of aligned apertures, ones of said links which are adjacent said selected one of said links are restrained from passage between said pins.

8. An assembly according to claim 7 wherein at least one of said second plate portions has at least one additional aperture for attachment of a lifting device to provide temporary lifting of the second structure while the selected link is being cinched.

9. An assembly according to claim 7 wherein said pins are scaffold pins.

10. An assembly according to claim 7 wherein said pins have locking parts which partially surround said device and are held down by the force of gravity to prevent removal of the pins respectively, wherein said locking parts must be lifted against the force of gravity to enable removal of the pins respectively.

11. An assembly according to claim 7 further comprising a clip including a curved shank for attaching underlying cables to said second structure, at least one aperture in said first plate portion for receiving at least one threaded portion of said shank, and at least one nut for applying to said at least one threaded portion for attaching said device to said clip.

* * * * *